US008240283B1

(12) United States Patent
Lewis

(10) Patent No.: US 8,240,283 B1
(45) Date of Patent: Aug. 14, 2012

(54) METHOD FOR PREPARING AND USING AN ENGINE VALVES ADJUSTMENT GUIDE STRIP

(76) Inventor: Richard Lee Lewis, Buena Park, CA (US)

( * ) Notice: Subject to any disclaimer, the term of this patent is extended or adjusted under 35 U.S.C. 154(b) by 426 days.

(21) Appl. No.: 12/584,633

(22) Filed: Sep. 8, 2009

(51) Int. Cl.
*F01L 1/18* (2006.01)

(52) U.S. Cl. ..... 123/90.43; 123/90.15

(58) Field of Classification Search ..... 123/90.15, 123/90.16, 90.43
See application file for complete search history.

(56) References Cited

U.S. PATENT DOCUMENTS 1,786,034 A 12/1930 Smith
2,837,713 A 6/1958 Schoenleber
4,580,446 A 4/1986 Ansteth
4,966,107 A 10/1990 Imajo
6,435,019 B1 8/2002 Vojtisek-Lom

OTHER PUBLICATIONS

MSD Installing Instruction, Dec. 2004.*

* cited by examiner

*Primary Examiner* — Zelalem Eshete
(74) *Attorney, Agent, or Firm* — Gene Scott; Patent Law & Venture Group

(57) ABSTRACT

Described is a method of making and using an adherent guide strip on a damper wheel of a piston engine to adjust engine valves. The method includes cutting the strip to a length sufficient to exactly encircle the damper wheel; placing midpoint marks onto a visible outside surface of the strip; engaging the strip with a peripheral edge of the crankshaft pulley while aligning the strip for corresponding rotational positions of the damper wheel; and guiding rotation and positioning of the crankshaft and camshaft by the midpoint marks on the guide strip in order to more easily and accurately adjust the engine's valves.

8 Claims, 3 Drawing Sheets

METHOD FOR PREPARING AND USING AN ENGINE VALVES ADJUSTMENT GUIDE STRIP

BACKGROUND OF THE INVENTION

1. Field of the Present Disclosure

This disclosure relates generally to valve adjustment in internal combustion engines such as automobile engines, and more particularly to a guide strip that may be fixed to the engines damper wheel for visual positioning of the crankshaft enabling adjustment of the engine's valves.

2. Description of Related Art Including Information Disclosed Under 37 CFR 1.97 and 1.98

Smith, U.S. Pat. No. 1,786,034, discloses an indicator comprising a rotatably mounted dial bearing indicia denoting the firing order of an internal combustion engine, indicating means coacting with the indicia, and electro-mechanical means for electrical connection to the ignition system of the engine and adapted to operate the dial to successively bring its indicia into register with the indicating means.

Schoenleber, U.S. Pat. No. 2,837,713, discloses a means for timing the ignition in an internal combustion engine of the type having a fan belt pulley adapted to be moved in synchronism with the crank shaft, a pointer carried by the pulley and formed of conducting material, a dial of conducting material carried adjacent the pulley and in close proximity to the path of travel of the pointer, the dial being insulated from the engine and the pulley and having an indexing mark, adapted to coincide with the pointer when a piston of the engine is at top dead center, and an electrical connection between the ignition system and the dial for electrifying the dial when a spark would normally occur with respect to the top dead center, piston so that a spark occurs between the dial and the pointer, enabling thereby the advance or retard of the spark to be observed in the relationship to the indexing mark while the engine is running.

Ansteth, U.S. Pat. No. 4,580,446, discloses an improved degree wheel which is adjustably rotatable relative to the crankshaft on which it is carried. The wheel can be easily adjusted so that a zero degree reading corresponds to top dead center of piston travel. Much of the calculation necessary to determine cam phasing, cam lobe centerline, valve overlap, and the like is thereby eliminated. The degree wheel preferably includes counterclockwise 0-360 degree indicia for a direct and calculation-free determination of the duration of tappet lift.

Imajo, U.S. Pat. No. 4,966,107, discloses a valve clearance adjustment method effective in improving smoothness of an idle operation of a multi-cylinder internal combustion engine at a low engine speed. This method features steps of selecting a crankshaft angle where one of an intake valve and an exhaust valve is seated while the other valve is being lifted from its seated position, and conducting the adjustment of a valve clearance for the seated valve at this crankshaft angle.

Vojtisek-Lom U.S. Pat. No. 6,435,019 discloses an improved mass emissions measuring system for an internal combustion engine. In the preferred embodiment, the system is comprised of a particulate monitor, four sensor which may be temporarily attached to the engine for sensing operating parameters of the engine, an engine-control interface, a processor programmed to collect and manipulate data from the monitor and the sensors and/or engine-control interface, a display for displaying the particulate emissions of the engine, an exhaust sampling system which is adapted to be temporarily connected between the exhaust system of the engine and the particulate monitor, and an opacity meter. The particulate monitor may comprise a first photometer, a second photometer, an impactor located upstream from the second photometer, whereby the impactor limits the size of particulates in the exhaust of the engine communicating with the second photometer, and a microbalance adapted to measure the mass of the particulate matter in the exhaust communicating with the photometer. The system is adapted for use on-board a moving vehicle.

The related art described above discloses ways and means for more easily making adjustments to the valves of a piston engine. However, the prior art fails to disclose an adherent strip for attachment to a damper wheel, where the strip having markings for visual alignment of the several cams of the engine for improved valve adjustment. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

The present invention is a method of making and using a guide strip secured to a damper wheel of an engine to adjust engine valves. The method includes cutting the strip to a length sufficient to encircle the damper wheel; placing midpoint marks onto a visible outside surface of the strip; engaging the strip with a peripheral edge of the damper wheel while aligning the midpoint marks with a calibrating mark on the damper wheel; and using the marks on the guide strip in order to more easily and accurately adjust the engine's valves.

A primary objective inherent in the above described apparatus and method of use is to provide advantages not taught by the prior art.

Another objective is to provide a method of making and using a guide strip for visual positioning of an engine for valve adjustment.

A further objective is to provide such a strip that provides visual distinction between rotational positions of the engine for valve adjustment during a first and a second full rotation of the damper wheel.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention. In such drawing(s):

Figure 4:
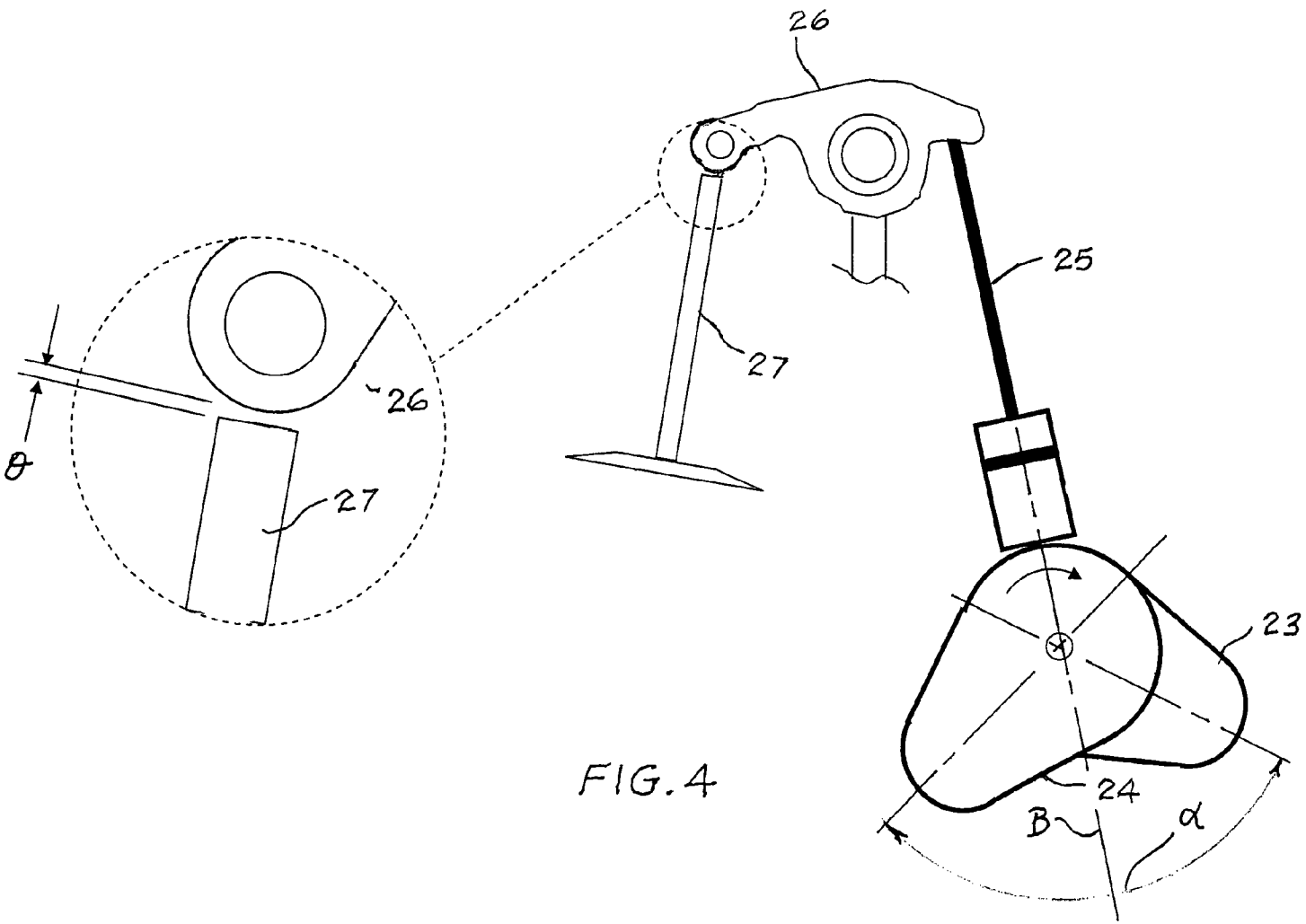
Figure 5:
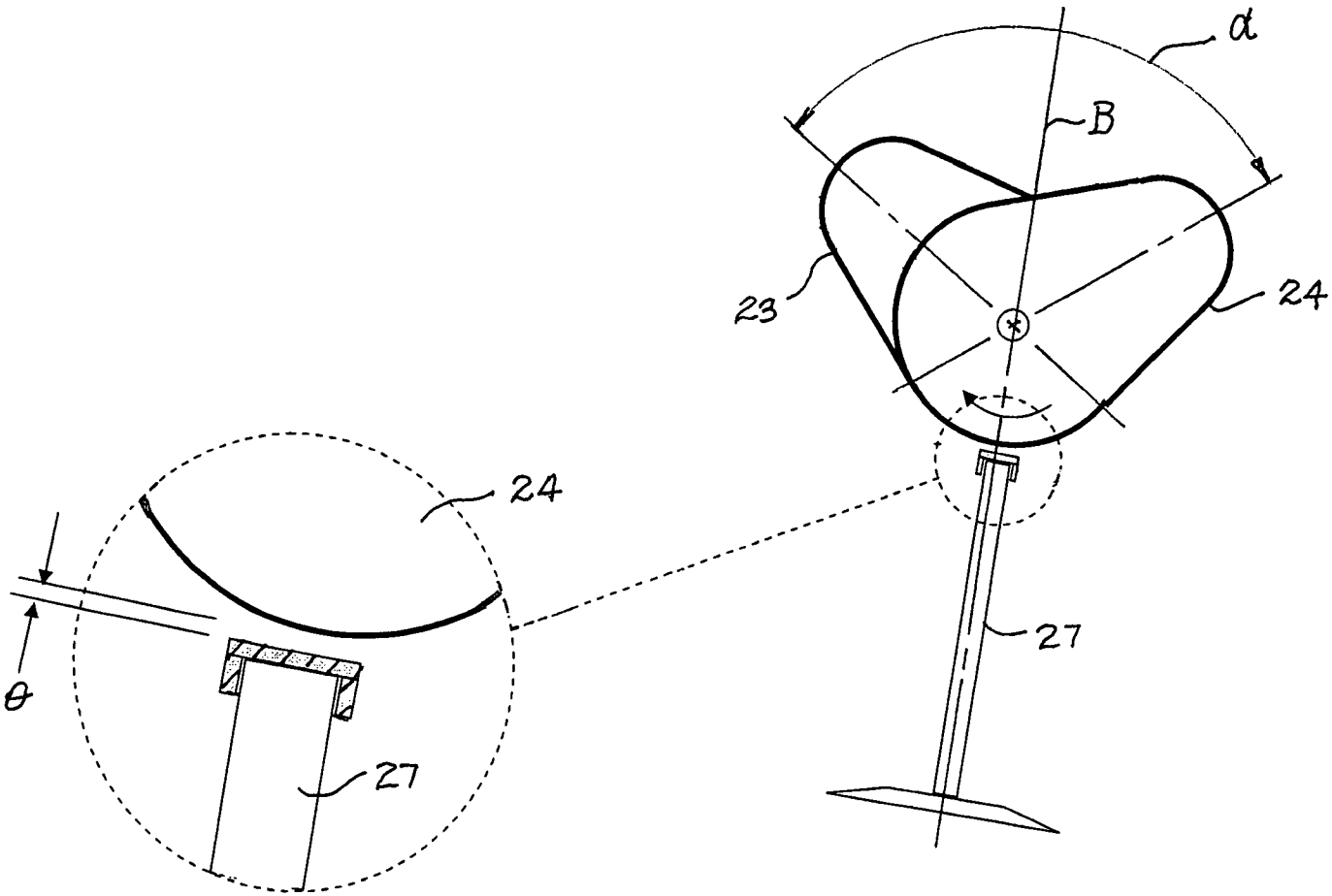

FIG. 4 is a schematic diagram illustrating the desirable positions of intake and exhaust cams for valve adjustment in an engine using rocker arms, and including an enlarged portion illustrating valve lash; and FIG. 5 is a schematic diagram illustrating the desirable positions of intake and exhaust cams for valve adjustment in an overhead cam type engine, and including an enlarged portion illustrating valve lash.

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Figure 1:
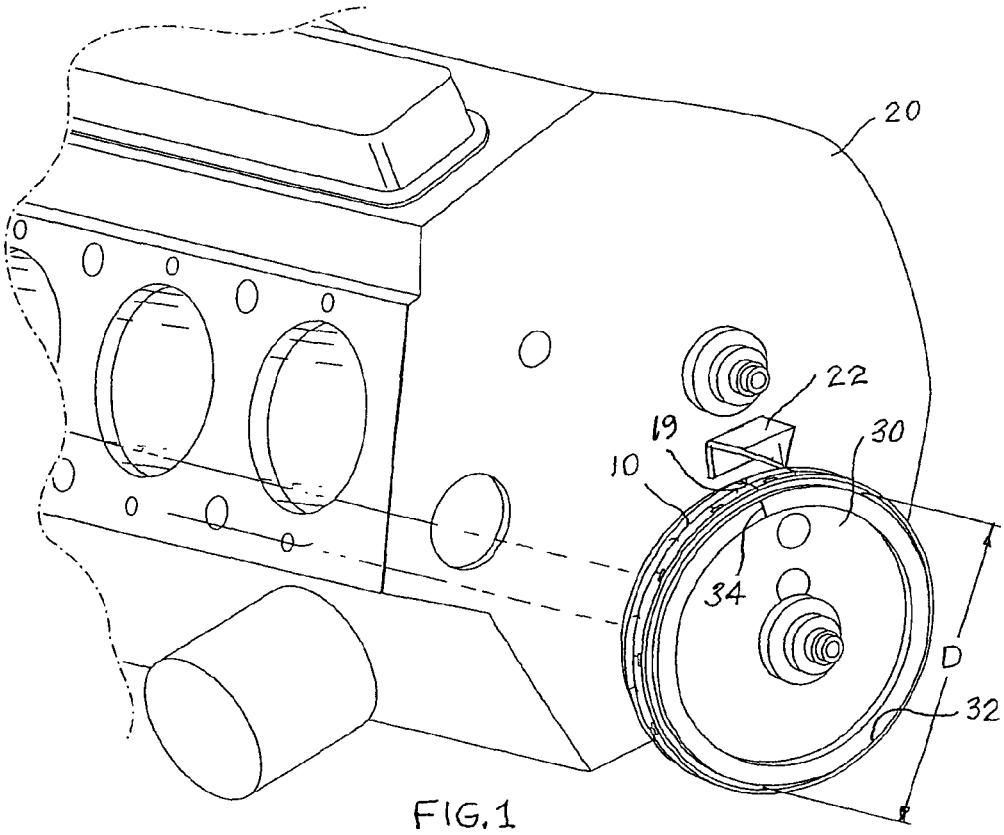
FIG. 1 is a perspective view of the front end of an internal combustion engine showing a damper wheel with a guide strip secured around it.

This invention is a method for producing and using a guide strip 10 for more easily rotating an internal combustion engine 20 for valve adjustment, wherein the engine 20 has "n" cylinders, and is constructed in accordance with conventional automotive practice. A crankshaft pulley, which is referred to herein as a damper wheel 30 (FIG. 1) rotates with the engine 20 so that any angular rotation of the damper wheel 30 is an indication that the engine 20 has rotated by the same angle. The damper wheel 30 has a peripheral circumferential edge 32 with a circumference "C." The guide strip 10 is secured to this peripheral edge 32 as shown in FIG. 1, and as will be further described.

Figure 2:
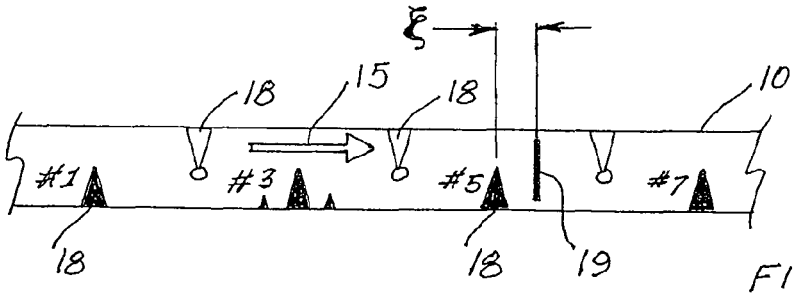
FIG. 2 is a plan view of a portion of the guide strip showing the obverse surface thereof.
Figure 3:
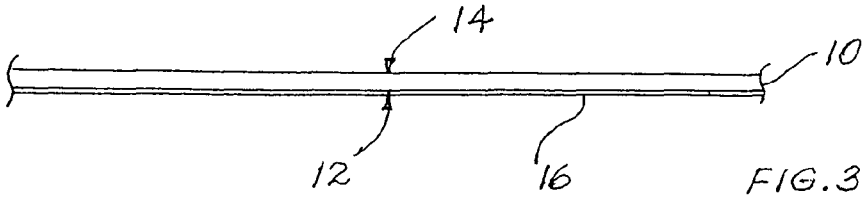
FIG. 3 is an edge view of the guide strip.

A flexible, non-extensible material such as Mylar® is used to fabricate the guide strip 10 with a length equal to C and a width preferably approximating the width of the damper wheel 30. Circumference C is calculated as pi times the diameter "D" of the damper wheel 30, which may be measured with a ruler. Next, the reverse side 12 of the guide strip 10 is adapted for attachment to the circumferential edge 32 of the damper wheel 30, preferably by magnetic attraction or by a bonding agent 16 or by any other means where the attachment is fixed and may be permanent. The obverse side of the guide strip 10 is adapted with a plurality of transverse marks 18, the marks spaced apart longitudinally on the obverse side by a distance of 2 C/n between them, which this is the angle of rotation that the engine travels between ignitions, and is expressed in linear units of measurement. An alignment mark 19 is placed on guide strip 10. An offset angle ($\xi$) is defined between any one of the marks 18 and alignment mark 19 as shown in FIG. 2. Offset angle $\xi$ is calculated as:

$$\xi = I - S$$

In the above formula, I is the "intake lobe centerline angle", and S is the "lobe separation angle," both of which are specified by the engine manufacturer and these terms (in quotation marks) are well known and understood in the field of this invention. With the guide strip 10 fixed on damper wheel 30 with alignment mark 19 aligned with a top-dead-center (TDC) marker 34 on damper wheel 30, all of the marks 18 on guide strip 10 are then functional for indicating specific rotational positions of engine 20 for adjusting its intake and exhaust valves. This is accomplished by rotating engine 20 according to arrow 15, and aligning marks 18, in turn, with engine marker 22.

Each mark 18, when aligned with engine marker 22 (FIG. 1), positions a corresponding pair of cams 23 and 24 at their "midpoint" wherein both intake and exhaust valves are fully closed. The midpoint position is defined as that rotational position of the cams 23 and 24 where a bisector (B) of the lobe separation angle $\alpha$ is co-linear with valve actuators, and simultaneously, the heels of the cams 23 and 24 are in contact with the valve actuators. The valve actuators are push rods with lifters 25 in an engine using rocker arms 26, as shown in FIG. 4, and are valve stems 27 in an overhead cam engine, as illustrated in FIG. 5. Adjustment of the valves includes setting valve lash $\theta$ to specification.

The appearance of the marks 18 are adapted so that each alternately positioned one of the marks 18 is visually discernable as relating to a first set of the marks 18, and the remaining marks are visually discernable as relating to a second set of marks 18 where the two sets are visually distinguishable. For example, in FIG. 2, the marks 18 abutting the lower edge of guide strip 10 are filled-in and appear dark, while the marks 18 abutting the upper edge of guide strip 10 are not filled-in and appear light in color. The first set of marks 18 relate to the valves of the engine 20 that are adjusted, in the present method, in a first full rotation of engine 20 while the second set of marks 18 relate to the valves of the engine 20 that are adjusted in a second rotation of engine 20. It is clear that the mark sets may be discernable by their color, shading, location or other factors. In the present example, the marks 18 are triangular in shape, but the sets can be discerned by shape as one set of marks 18 are modified. Notice that the marks 18 along the upper edge of guide strip 10 in FIG. 2 have a distinctive shape as compared to those along the lower edge. Preferably, as pointed out above, an arrow 15 (FIG. 2) is located on the obverse surface of the guide strip 10 to indicate the direction of rotation of the engine 20 during valve adjustment and such adjustment is conducted by rotating the engine 20 in only the direction of arrow 15. Furthermore, tolerance span marks, and cylinder numbers may be placed on the obverse side of the guide strip 10 as also shown in FIG. 2.

Respective valves for the first one of the cylinders are adjusted for proper valve lash according to engine specification and thereafter the engine 20 is rotated to position each further one of the first set of the marks 18, in turn, into alignment with the engine marker 22 and then adjusting, in turn, the respective valves for proper valve lash. Finally, the engine 20 is rotated to position each of the second set of the marks 18, in turn, into alignment with the engine marker 22 and adjusting, in turn, respective valves thereof for proper valve lash in accordance with engine specifications.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments.

Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A method for producing and using a guide strip for adjusting the valves of an internal combustion engine; the method comprising:

a) preparing a flexible, non-extensible, strip having a length equal to a circumference C of a damper wheel of the engine;

b) adapting an outfacing side of the strip with a plurality of transverse marks, the marks spaced apart on the outfacing side by a distance of 2 C/n where n is the number of cylinders of the engine;

c) adhering the strip to a circumferential edge of the damper wheel in a position where one of the marks is offset from a TDC marker of the damper wheel;

d) aligning each one of the marks in turn with an engine marker and adjusting, in tum, the valves corresponding to the cylinders related to the marks;

e) adapting the appearance of the marks so that each alternately positioned one of the marks is discernible as relating to a first set of the marks, and the remaining marks are discernible as relating to a second set of marks; and carrying out step (d) for the first set of marks and only then for the second set of marks.

2. The method of claim 1 wherein for each of the marks aligned with the engine marker, a bisector of a lobe separation angle of corresponding cams is aligned with valve actuators and cam heels are in contact with the valve actuators.

3. The method of claim 1 wherein the adapting of the appearance of the marks comprises the further step of distinguishing the first set of marks with a first color and distinguishing the second set of marks with a second color.

4. The method of claim 1 wherein the adapting of the appearance of the marks comprises the further step of distinguishing the first set of marks with a first shape and distinguishing the second set of marks with a second shape.

5. The method of claim 1 wherein the adapting of the appearance of the marks comprises the step of distinguishing the first and second sets of marks by relationships between the respective sets of the marks with respective opposing edges of the guide strip.

6. The method of claim 1 wherein the step of adapting of the reverse side of the guide strip for attachment to the circumferential edge of the damper wheel is by one of mechanical and magnetic attachment means.

7. The method of claim 1 further comprising the step of placing an arrow on the obverse surface of the guide strip, the arrow positioned for indicating a direction of rotation of the engine during valve adjustment.

8. A method for adjusting the valves of an internal combustion engine, the method comprising the steps of:

a) positionally locating the engine to form an angle between an engine marker and a TDC marker of a damper wheel of the engine, and thereafter, in turn, positionally locating the engine in each of n positions where each of the n positions is separated by 720/n degrees, where n is the number of cylinders of the engine;

b) adjusting valve lash for each respective cylinder at each of the positional locations of step (a);

c) adapting the appearance of a plurality of marks so that each alternately positioned one of the marks is discernible as relating to a first set of the marks, and the remaining marks are discernible as relating to a second set of marks; and (d) carrying out step (b) for the first set of marks and only then for the second set of marks.

* * * * *